United States Patent [19]

Boyer et al.

[11] 4,265,777

[45] May 5, 1981

[54] DETERGENT COMPOSITIONS CONTAINING AN ALUMINOSILICATE DETERGENCY BUILDER AND AN UNSATURATED FATTY ACID SOAP

[75] Inventors: Stanton L. Boyer, Fairfield; Denzel A. Nicholson, Cincinnati, both of Ohio

[73] Assignee: The Procter & Gamble Company, Cincinnati, Ohio

[21] Appl. No.: 141,222

[22] Filed: Apr. 17, 1980

[51] Int. Cl.[3] ..... C11D 3/12; C11D 9/18; C11D 10/04

[52] U.S. Cl. ..... 252/113; 252/110; 252/117; 252/120; 252/131; 252/140; 252/155; 252/174.14; 252/174.25; 252/179

[58] Field of Search ..... 252/110, 113, 117, 120, 252/131, 140, 155, 174.25, 179

[56] References Cited

U.S. PATENT DOCUMENTS

| | | | |
|---|---|---|---|
| 2,677,665 | 5/1954 | James | 252/131 |
| 4,073,867 | 2/1978 | Roebke | 252/131 X |
| 4,083,793 | 4/1978 | Jakobi | 252/99 |
| 4,092,261 | 5/1978 | Sperling | 252/131 |
| 4,136,051 | 1/1979 | Saran | 252/91 |
| 4,148,603 | 4/1979 | Schwuger | 8/137 |

FOREIGN PATENT DOCUMENTS

| | | | |
|---|---|---|---|
| 849234 | 4/1977 | Belgium | 252/140 |
| 2422655 | 11/1974 | Fed. Rep. of Germany | 252/131 |
| 2729995 | 1/1979 | Fed. Rep. of Germany | 252/131 |
| 26-1119 | 3/1951 | Japan | 252/131 |
| 5691/78 | of 0000 | United Kingdom . | |

OTHER PUBLICATIONS

Smolka, H. G., et al.: "The Use of Sodium Aluminum Silicates in Detergents, Part VI", Tenside Detergents, vol. 14, No. 4, pp. 222–228, 1977.

*Primary Examiner*—Dennis L. Albrecht
*Attorney, Agent, or Firm*—Robert B. Aylor; Richard C. Witte; Thomas H. O'Flaherty

[57] ABSTRACT

Detergent compositions comprising water-insoluble aluminosilicate detergency builder; a synthetic detergent surfactant; and an unsaturated, water-soluble or dispersible soap of an unsaturated fatty acid containing from about 16 to about 22 carbon atoms. The soap improves the detergency, especially of particulate and body soils.

15 Claims, No Drawings

DETERGENT COMPOSITIONS CONTAINING AN ALUMINOSILICATE DETERGENCY BUILDER AND AN UNSATURATED FATTY ACID SOAP

TECHNICAL FIELD

This invention relates to detergent compositions for use in washing textiles. The detergent compositions can be in any convenient form, including granules, pastes, solid shapes and liquids. In a preferred variation, the detergent compositions of this invention are substantially free of phosphate- and nitrogen-containing detergency builders.

BACKGROUND ART

Aluminosilicate detergency builders have been disclosed in the prior art in combination with a variety of surfactant systems, including soaps. Soaps have been used as detergent surfactants for centuries. However, their use has been declining and the soaps utilized in the modern times are soaps of saturated fatty acids.

SUMMARY OF THE INVENTION

The present invention relates to detergent compositions consisting essentially of:

(a) from about 1% to about 20% of synthetic detergent surfactant selected from the group consisting of:
  (1) water-soluble nonionic detergent surfactants;
  (2) water-soluble synthetic anionic detergent surfactants;
  (3) water-soluble zwitterionic detergent surfactants;
  (4) water-soluble amphoteric detergent surfactants;
  (5) water-soluble semi-polar nonionic detergent surfactants; and
  (6) mixtures thereof;

(b) from about 5% to about 60% of a water-soluble or dispersible soap of unsaturated fatty acids containing from about 16 to 22 carbon atoms; and (c) from about 5% to about 50% of a water-insoluble inorganic detergency builder selected from the group consisting of;
  (1) zeolite A;
  (2) zeolite X;
  (3) zeolite P (B);
  (4) amorphous hydrated aluminosilicate material of the empirical formula $M_z(zAlO_2.ySiO_2)$ wherein M is sodium, potassium or ammonium; z is from about 0.5 to about 2; and y is 1, said zeolites A, X and P having a particle size diameter of from about 0.01 microns to about 25 microns and containing at least 10% water of hydration and said amorphous material having a particle size diameter of less than about 25 microns, and magnesium ion exchange capacity of at least about 50 milligram equivalents of calcium carbonate hardness per gram of anhydrous aluminosilicate, and a magnesium ion exchange rate of at least about 1 grain/gallon/minute/gram/gallon; and
  (5) mixtures thereof;

(d) the balance preferably being selected from the group consisting of water, sodium sulfate, $C_{1-4}$ alcohols, sodium silicates, sodium carbonate, and mixtures thereof.

DISCLOSURE OF THE INVENTION

This invention comprises the discovery that certain unsaturated fatty acid soaps are surprisingly effective surfactants for detergent compositions containing aluminosilicate detergency builders, especially hydrated zeolites A and X and most especially zeolite A. The presence of the unsaturated soap provides benefits in the area of particulate soil removal, body soil removal, and cool water detergency, especially when used with another detergent surfactant, preferably one which is an effective curd dispersant while minimizing and/or eliminating the formation of soap curd. A special advantage of this invention is that it provides good detergency either in the absence or presence of conventional phosphate and polycarboxylate detergency builders. In the presence of phosphate builders the addition of soap provides only particulate soil removal benefits over the same composition without the soap.

The essential elements in the detergent compositions of this invention are the aluminosilicate detergency builder and the combination of unsaturated fatty acid soap and synthetic detergent.

The Aluminosilicate Detergency Builder

The crystalline aluminosilicate materials for use herein are those commonly known as hydrated zeolites A, X and P(B) preferably A and X, most preferably A. These crystalline materials should contain at least about 10% water of hydration, preferably at least about 18% water of hydration and should have a particle size of from about 0.01 micron to about 25 microns, preferably from about 0.1 micron to about 10 microns, more preferably from about 0.5 micron to about 5 microns. Preferably the crystal size should be from about 0.1 to about 1.5 microns. These aluminosilicate materials are more fully described in U.S. Pat. No. 4,096,081, Phenicie et al, issued June 20, 1978. Zeolite A is the preferred aluminosilicate material having the largest capacity for controlling hardness and having been exhaustively tested for its overall characteristics.

Further disclosure of the above zeolite aluminosilicate materials and of the amorphous aluminosilicate materials useful herein can be found in U.S. Pat. No. 4,180,485, Llenado, issued Dec. 25, 1979. Both of the above patents are incorporated herein by reference.

The above aluminosilicate detergent builders should preferably be free of any substantial amount of particles having a diameter above about 10 microns. Also, in the case of the zeolite materials, they should have a calcium ion exchange capacity of at least about 100 milligram equivalents of calcium carbonate per gram, preferably at least 200 milligram equivalents of calcium carbonate per gram, and most preferably at least 250 milligram equivalents of calcium carbonate per gram on an anhydrous basis. The initial ion exchange rate of these zeolites should be at least 2 grains/gallon/minute/gram/gallon as measured at room temperature in the presence of 7 grains of mixed 2:1 $Ca^{++}$:$Mg^{++}$ and a level of detergency builder sufficient to control that level of hardness. This initial rate can be approximated by drawing a line from the initial point to the level of hardness after ½ minute as determined by a calcium ion specific electrode.

The amorphous materials useful herein should have a magnesium ion exchange capacity of at least about 50 milligram equivalents of calcium carbonate, preferably at least about 75 milligram equivalents of calcium carbonate hardness per gram of anhydrous aluminosilicate and a magnesium ion exchange rate of at least about 1 grain/gallon/minute/gram/gallon.

The amount of aluminosilicate detergency builder in the compositions is from about 5% to about 50%, preferably from about 15% to about 40%, most preferably from about 20% to about 30%. The aluminosilicate detergency builder is preferably present at a level to control from about 65% to about 80% of the hardness.

The Unsaturated Soap

The unsaturated fatty acid soap of this invention contains from about 16 to about 22 carbon atoms, preferably in a straight chain configuration. Preferably the number of carbon atoms in the unsaturated fatty acid soap is from about 16 to about 18.

This unsaturated soap, in common with other anionic detergents and other anionic materials in the detergent compositions of this invention, has a cation which renders the soap water-soluble and/or dispersible. Suitable cations include sodium, potassium, ammonium, monethanolammonium, diethanolammonium, triethanolammonium, tetramethylammonium, etc. cations. Sodium ions are preferred although in liquid formulations potassium, monoethanolammonium, diethanolammonium, and triethanolammonium cations are useful.

A level of at least about 5% of the unsaturated fatty acid soap is desirable to provide a noticeable improvement in performance. Preferred levels of unsaturated fatty acid soap are from about 5% to about 60%, preferably from about 10% to about 40%, most preferably from about 10% to about 20%. The unsaturated fatty acid soap is preferably present at a level that will provide a level of from about 150 ppm to about 600 ppm, preferably from about 150 ppm to about 300 ppm in the wash solution at recommended U.S. usage levels and from about 150 ppm to about 2400 ppm, preferably from about 600 ppm to about 1500 ppm for European usage levels. Surprisingly, the aluminosilicate assists in keeping the unsaturated soap from forming an insoluble curd.

Mono-, di-, and triunsaturated fatty acids are all essentially equivalent so it is preferred to use mostly monounsaturated soaps to minimize the risk of rancidity. Suitable sources of unsaturated fatty acids are well known. For example, see Bailey's Industrial Oil and Fat Products, Third Edition, Swern, published by Interscience Publisher (1964), incorporated herein by reference.

Preferably, the level of saturated soaps is kept as low as possible, preferably less than about 50% of the unsaturated soap. However, low levels of saturated soaps can be added and will provide some performance for clay removal if they contain at least 16 carbon atoms. Preferably the level of saturated soap does not exceed the level of unsaturated soap. Tallow and palm oil soaps can be used if cost considerations are important, but will not give as good results as can be obtained with all unsaturated soap. Coconut soap does not provide a benefit and should not be added in significant amounts.

The Synthetic Surfactant

In addition to the unsaturated fatty acid soap there is a synthetic surfactant present, especially one which is an efficient soap curd dispersant. The synthetic detergent surfactant is selected from the group consisting of water-soluble nonionic, anionic, zwitterionic, amphoteric, and semi-polar nonionic detergent surfactants and mixtures thereof. Especially preferred surfactants and mixtures of surfactants are those which are relatively hardness insensitive.

Suitable synthetic detergent surfactants include:

(1) Nonionic Detergent Surfactants.

Nonionic surfactants can be prepared by a variety of methods well known in the art. In general terms, such nonionic surfactants are typically prepared by condensing ethylene oxide with a compound containing an active hydrogen under conditions of acidic or basic catalysis. Nonionic surfactants for use herein comprise those typical nonionic surface active agents well known in the detergency arts. Useful nonionic surfactants include those described in U.S. Patent No. 4,075,118, issued to Gault et al. on Feb. 21, 1978; U.S. Pat. No. 4,079,078 issued to Collins on Mar. 14, 1978; and U.S. Pat. No. 3,963,649 issued to Spadini et al. on June 15, 1976, all of the above patents being incorporated herein by reference.

The more conventional nonionic surfactants useful herein are those having the formula:

$$R(Z)(C_2H_4O)_XO—R^1$$

wherein R is an alkyl, hydroxy alkyl, alkylene, hydroxy alkylene, acyl, or hydroxy acyl group containing from about 8 to about 22 carbon atoms or an alkylbenzene group wherein the alkyl group contains from about 6 to about 15 carbon atoms or mixtures thereof; Z is selected from the group consisting of $$—O—,\ —N=,\ —N\begin{matrix}\diagup R^1\\ \diagdown\ \ \end{matrix},$$

and mixtures thereof; X is a number from 0 to about 30; and R′ is selected from the group consisting of H, alkyl groups containing from 1 to about 4 carbon atoms, acyl groups containing from 2 to about 4 carbon atoms and mixtures thereof. The HLB of these nonionic surfactants is preferably from about 5 to about 20, most preferably from about 8 to about 14.

(2) Anionic Detergent Surfactants.

This class of detergents includes the water-soluble salts of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups).

A formula for representative anionic surfactants is:

$$R(O)_y(R^2O)_xSO_3M$$

wherein R has the meaning given hereinbefore; Y is 0 or one, but is always one when x is more than 0; $R^2$ is selected from the group consisting of $—C_2H_4—$, $—CH_2CHOH—CH_2—$, $—CH_2CH(CH_3)—$, and mixtures thereof; x can vary from 0 to about 30; and M is selected from the group consisting of Na, K, $—N(C_2H_4OH)_{0-3}(H)_{1-4}$, Ca, Mg, or mixtures thereof.

Examples of this group of synthetic detergents which form a part of the detergent compositions of the present invention are the sodium, potassium, ammonium, monoethanolammonium, diethanolammonium, and triethanolammonium salts of: alkyl sulfates, especially those obtained by sulfating the higher alcohols ($C_8$–$C_{18}$ carbon atoms) produced by reducing the glycerides of tallow or coconut oil; and alkyl polyethoxy sulfates in which the alkyl group contains from about 8 to 22 carbon atoms and the number of ethoxy ether groups is from about 1 to about 10; olefin sulfonates containing from about 8 to about 22 carbon atoms; paraffin sulfonates containing from about 8 to about 22 carbon atoms; alkyl benzene sulfonates in which the alkyl group contains from about 9 to about 15 carbon atoms in straight chain or branched chain configuration, e.g., those of the type described in U.S. Pat. Nos. 2,220,099 and 2,477,383.

Other anionic detergent compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

The cations of the above anionic surfactants are the same as for the unsaturated soaps.

(3) Zwitterionic Detergent Surfactants.

Zwitterionic detergents include derivatives of aliphatic quaternary ammonium, phosphonium, and sulphonium compounds in which the aliphatic moieties can be straight chain or branched, preferably straight chain and wherein one of the aliphatic substituents contains from about 8 to about 18 carbon atoms and one contains an anionic water-solubilizing group. The general formula is $RL^{\oplus} R^3_{2-3}$ where R has the meaning given hereinbefore, $R^3$ is an alkyl group containing from 1 to about 22 carbon atoms; R or one of the $R^3$ groups being substituted with T; the portion of R or $R^3$ between L and T preferably being interrupted by one to about 10 groups selected from the group consisting of ether, ester, and amide groups and mixtures thereof; wherein L is N, P or S; and T is $—SO_4^{\ominus}$, $—COO^{\ominus}$, or $—SO_3^{\ominus}$, there being no more than one hydrophobic group.

(4) Amphoteric Detergent Surfactants.

Amphoteric detergents include derivatives of aliphatic, or derivatives of heterocyclic, secondary and tertiary amines in which there is an aliphatic moiety which can be straight chain or branched chain and wherein one of the aliphatic substituents contains from about 8 to about 18 carbon atoms and at least one aliphatic substituent contains an anionic water-solubilizing group.

The formula for these amphoteric detergent surfactants is essentially the same as for the zwitterionic detergent surfactants, but with one less $R^3$ group.

(5) Semi-Polar Nonionic Detergent Surfactant.

Suitable semi-polar nonionic detergent surfactants include tertiary amine oxides containing a straight or branched chain saturated or unsaturated aliphatic hydrocarbon, hydroxy hydrocarbon or halohydrocarbon radical in which the alkyl portion contains from 8 to 24 carbon atoms and two short chain methyl, ethyl, hydroxymethyl or hydroxyethyl radicals. Other suitable semi-polar nonionic detergent surfactants include the corresponding tertiary phosphine oxides and the sulfoxides.

The formula for representative surfactants is $$R(C_2H_4O)_xL(\overset{O}{\uparrow}R^4)_{1-2}$$

where R and L and x are as stated hereinbefore and each $R^4$ is selected from the group consisting of $C_{1-4}$ alkyl and hydroxy alkyl groups and polyethoxylate groups containing from 1 to about 10 ether linkages, said $R^4$ groups optionally being connected through an oxygen or a nitrogen atom.

Mixtures of all of the above synthetic detergent surfactants can be used and are usually preferred. The most preferred detergent surfactants are anionic, amphoteric, zwitterionic and semipolar nonionic detergent surfactants with nonionic detergent surfactants being used only as part (preferably minor) of a surfactant mixture. Sucrose esters and amides have been demonstrated to be ineffective and should only be used as minor components in the detergent surfactant mixture. Preferably sucrose esters are used in amounts less than about 2%, preferably less than about 1% and are preferably not present.

Preferred synthetic detergent surfactants for use herein include $C_{11-15}$ alkyl polyethoxylate (1–5) sulfates; $C_{11-15}$ alcohol polyethoxylates (1–10); $C_{10-16}$ alkyl di-$C_{1-4}$ alkyl amine oxides; and mixtures thereof.

Preferably the synthetic detergent surfactant is present in from about 2% to about 15%.

Miscellaneous Ingredients

In addition to the above named ingredients, the compositions of this invention can contain all of the usual components of detergent compositions including the ingredients set forth in U.S. Pat. No. 3,936,537, Baskerville et al, incorporated herein by reference. Such components include color speckles, bleaching agents, bleach activators, suds boosters, suds suppresors, antitarnish and/or anticorrosion agent, soil-suspending agents, soil-release agents, dyes, fillers, optical brighteners, germicides, pH adjusting agents, alkalinity sources, hydrotropes, antioxidants, enzymes, enzyme stabilizing agents, perfumes, etc.

The optional components include bleaching agents such as sodium perborate (as the monohydrate or tetrahydrate), sodium percarbonate and other perhydrates, at levels from about 5% to 35% by weight of the composition, and activators therefor, such as tetraacetyl ethylene diamine, tetraacetyl glycouril and other known in the art, and stabilizers therefor, such as magnesium silicate, and ethylene diamine tetraacetate.

Preferred optional ingredients include suds modifiers particularly those of suds suppressing types, exemplified by silicones, and silica-silicone mixtures.

U.S. Pat. Nos. 3,933,672 issued Jan. 20, 1976, to Bartollota et al, and 4,136,045, issued Jan. 23, 1979 to Gault et al, incorporated herein by reference, disclose silicone suds controlling agents. The silicone material can be represented by alkylated polysiloxane materials such as silica aerogels and xerogels and hydrophobic silicas of various types. The silicone material can be described as siloxane having the formula:

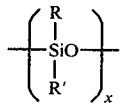

wherein x is from about 20 to about 2,000 and R and R′ are each alkyl or aryl groups, especially methyl, ethyl, propyl, butyl and phenyl. The polydimethylsiloxanes (R and R′ are methyl) having a molecular weight within the range of from about 200 to about 2,000,000, and higher, are all useful as suds controlling agents. Additional suitable silicone materials wherein the side chain groups R and R′ are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpoly-siloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 1:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in U.S. Pat. No. 4,073,118, Gault et al, issued Feb. 21, 1978, incorporated herein by reference. An example of such a compound is DB-544, commercially available from Dow Corning, which is a siloxane/glycol copolymer.

Suds modifiers as described above are used at levels of up to approximately 2%, preferably from about 0.1 to about 1½% by weight of the surfactant.

Low levels of water-soluble detergency builders, e.g., from about 1% to about 35%, preferably from about 5% to about 20% can also be used.

Nonlimiting examples of suitable water-soluble inorganic alkaline detergent builder salts include the alkali metal carbonates, borates, phosphates, polyphosphates, tripolyphosphates, bicarbonates, and silicates. Specific examples of such salts include the sodium and potassium tetraborates, bicarbonates, carbonates, tripolyphosphates, pyrophosphates, pentapolyphosphates and hexametaphosphates. Sulfates are usually present also.

Organic chelating agents that can be incorporated include citric acid, nitrilotriacetic and ethylene diamine tetraacetic acids and their salts, organic phosphonate derivatives such as those disclosed in Diehl U.S. Pat. No. 3,213,030, issued Oct. 19, 1965; by Roy U.S. Pat. No. 3,433,021, issued Jan. 14, 1968; Gedge, U.S. Pat. No. 3,292,121, issued Jan. 9, 1968; Bersworth U.S. Pat. No. 2,599,807, issued June 10, 1952; and carboxylic acid builders such as those disclosed in Diehl U.S. Pat. No. 3,308,067, issued Mar. 7, 1967; all of the foregoing patents being incorporated herein by reference.

Other organic chelating agents include the aminotrialkylidene phosphonates whose acids have the general formula

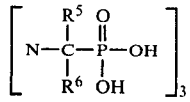

wherein $R^5$ and $R^6$ represent hydrogen or $C_1$–$C_4$ alkyl radicals. Examples of compounds within this general class are aminotri(methylenephosphonic acid), aminotri-(ethylidenephosphonic acid), aminotri-(isopropylidenephosphonic acid), aminodi-(methylenephosphonic acid)-mono-(ethylidenephosphonic acid) and aminomono-(methylenephosphonic acid) di-(isopropylidenephosphonic acid).

A very highly preferred class of polyphosphonates is that derived from the alkylene-polyaminopolyalkylene phosphonic acids. Especially useful examples of these materials include ethylene diamine tetramethylene phosphonic acid, diethylenetriamine pentamethylene phosphonic acid and hexamethylene diamine tetramethylene phosphonic acid. This class of materials has been found to be outstandingly good at overcoming the fabric yellowing tendencies of compositions based predominantly on nonionic surfactants and cationic softeners. Preferred salts of this class are the alkali metal, especially sodium, salts. The tri- or tetra- or pentasodium salts of diethylene triamine pentamethylene phosphonates are generally those present in the compositions. A mixture of the salts may be employed.

Preferred chelating agents include citric acid, nitrilotriacetic acid (NTA), nitrilotrimethylene phosphonic acid (NTMP), ethylene diamine tetra methylene phosphonic acid (EDTMP), and diethylene triamine penta methylene phosphonic acid (DETPMP).

Preferably from 0.2 to 2% of the phosphonate salt is present by weight of the composition.

Preferred soil suspending and anti-redeposition agents include methyl cellulose derivatives and the copolymers of maleic anhydride and either methyl vinyl ether or ethylene, e.g., Gantrez AN119 or Gantrez 595 (trade names of GAF).

As used herein, all percentages, parts and ratios are by weight unless otherwise specified.

The following compositions were tested by washing swatches of polyester stained with clay and swatches of polyester and cotton soiled with body soil in mini-washers at a detergent composition concentration of about 0.15% and 100° F. in 4 grains hardness (5, 6, 7 and 8 were run at 6 grains hardness which is a more stressed condition.) The clay swatches were measured to obtain the difference in Hunter Whiteness Units (HWU) from the control with a difference of 5 HWU being significant and the body soil swatches were graded by expert panelists with a grade of 0 being comparable to the control and a grade of 3 being a very large difference. These grades are referred to as panel score units (PSU). A difference of 1 PSU is significant. The values given are not all based on the same number of cycles or tests and some were obtained at different times. However, the data are fairly representative. Compositions 1 and 7 were the high and low controls respectively. Compositions 1–4 are provided for comparison to demonstrate the criticality of the ingredients.

EXAMPLE I

| Component | % by weight 1 | 2 | 3 | 4 | 5 | 6 |
|---|---|---|---|---|---|---|
| Sodium zeolite A, 3-4μ average particle size (~1 μ crystals) | 0 | 25 | → | → | → | → |
| $Na_2CO_3$ | 20 | 10 | → | → | → | → |
| Sodium linoleate | 0 | 0 | 0 | 15 | 0 | 10 |
| Sodium stearate | 0 | 0 | 0 | 0 | 15 | 0 |
| $C_{14-15}$ alcohol polyethoxylate (7) | 0 | → | → | → | → | → |
| Sodium alkyl* benzene sulfonate | 14 | 7.0 | 0 | 0 | 0 | 0 |
| Sodium $C_{14-15}$ alcohol polyethoxylate (2.25) sulfate | 6 | 5.5 | 10 | 0 | 10 | 10 |
| Sodium tallow alkyl sulfate | 0 | 5.5 | 0 | 0 | 0 | 0 |
| Sodium silicate (2.0r) | 4 | → | → | → | → | → |
| Sodium sulfate | ← | | Balance | | | → |
| ΔHWU | Control | 15 | 15 | 4 | 15 | 24 |
| ΔPSU | Control | 0.5 | 0.6 | 0 | −0.2 | 1.2 |

| Component | 7 | 8 | 9 | 10 | 11 | 12 |
|---|---|---|---|---|---|---|
| Sodium zeolite A, 3-4μ average particle size (~1 μ crystals) | → | → | → | → | → | → |
| $Na_2CO_3$ | 10 | → | → | → | → | → |
| Sodium linoleate | 15 | 50 | 15 | 15 | 15 | 15 |
| Sodium stearate | 0 | 0 | 0 | 0 | 0 | 0 |
| $C_{14-15}$ alkyl polyethoxylate (7) | → | → | → | → | → | 10 |
| Sodium $C_{12}$ alkyl benzene sulfonate | 0 | 0 | 0 | 0 | 10 | 0 |
| Sodium $C_{14-15}$ alkyl polyethoxylate (2.25) sulfate | 10 | 10 | 3 | 6 | 0 | 0 |
| Sodium tallow alkyl sulfate | 0 | 0 | 0 | 0 | 0 | 0 |
| Sodium silicate (2.0r) | ← | ← | ← | → | → | → |
| Sodium sulfate | ← | | Balance | | | → |
| ΔHWU | 27 | 33 | 12 | 20 | — | — |
| ΔPSU | 1.5 | 2.2 | 0.6 | 1.5 | 0.8 | 1.2 |

*$C_{13}$ for composition 1 and approximately $C_{12}$ for 2 and 11.

EXAMPLE II

| Components | % by weight 1 | 2 | 3 | 4 | 5 | 6 |
|---|---|---|---|---|---|---|
| Zeolite A of Ex. 1 | 0 | 10 | 25 | 50 | 0 | 0 |
| Na zeolite P (5.6μ average particle size) | 0 | 0 | 0 | 0 | 25 | 0 |
| Na zeolite X (2.7μ average particle size) | 0 | 0 | 0 | 0 | 0 | 25 |
| Sodium linoleate | 15 | → | → | → | → | → |
| Sodium $C_{14-15}$ alkyl polyethoxylate (2.25) sulfate | 10 | → | → | → | → | → |
| $Na_2CO_3$ | 10 | → | → | → | → | → |
| Sodium silicate (2.0r) | 4 | → | → | → | → | → |
| $Na_2SO_4$ | ← | | Balance | | | → |
| ΔHWU | Control | 5 | 15 | 30 | 6 | 13 |

As can be seen from the above, a level of greater than about 10% zeolite is required at this level of product usage and zeolite P is not acceptable at this product usage level and particle size.

EXAMPLE III

In this Example the compositions 25% of the zeolite of Example I, 15% sodium linoleate, 10% sodium $C_{14-15}$ alkyl polyethoxylate (2.25) sulfate, 4% sodium silicate, and the balance $Na_2SO_4$ was adjusted to the indicated pH's with the indicated results.

| pH | 7 | 8 | 9 | 10 | 11 |
|---|---|---|---|---|---|
| ΔHWU | control | 9 | 21 | 23 | 12 |
| ΔPSU | — | control | 1.5 | 2.2 | — |

Surprisingly, there is a maximum pH for optimum performance as shown above. Preferably the pH of the compositions of this invention at a 0.15% concentration in water is from about 8 to about 11, most preferably from about 9.5 to about 10.5.

EXAMPLES IV–VIII

| | % by weight IV | V | VI | VII | VIII |
|---|---|---|---|---|---|
| Zeolite of Example I | 20 | 0 | 35 | 10 | 0 |
| Amorphous Na zeolite, Al:Si = 2, <1μav. particle diameter | 12 | 0 | 0 | 0 | 0 |
| Na zeolite X, ~2μ av. particle diameter | 0 | 25 | 0 | 10 | 15 |
| Na $C_{14-15}$ olefin sulfonate | 5 | 0 | 0 | 0 | 0 |
| Na oleate | 0 | 10 | 0 | 0 | 0 |
| K linoleate | 15 | 0 | 0 | 0 | 10 |
| Na $C_{14-15}$ paraffin sulfonate | 0 | 7 | 0 | 0 | 0 |
| Na tallowate (I.V. 40) | 0 | 0 | 30 | 0 | 0 |
| Na palmate (I.V. 45) | 0 | 0 | 0 | 40 | 0 |
| Na α-sulfonated coconut methyl ester | | | | | |
| Coconut alkyl dimethyl amine oxide | 0 | 0 | 6 | 0 | 5 |
| $C_{14-15}$ alkyl polyethoxylate (7) | 0 | 0 | 0 | 0 | 4 |
| $Na_2CO_3$ | 20 | 16 | 10 | 15 | 0 |
| $Na_2SO_4$ | 15 | 0 | 0 | 15 | 0 |
| Na percarbonate | 0 | 25 | 0 | 0 | 0 |
| Na perborate monohydrate | 0 | 0 | 15 | 0 | 0 |
| $K_2CO_3$ | 0 | 0 | 0 | 0 | 7 |
| Ethyl alcohol | 0 | 0 | 0 | 0 | 3.5 |
| Dimethyl polysiloxane (M.W.-200,000) | 2 | 0 | 0 | 0 | 0 |
| Ethylene diamine tetramethylene phosphonic acid | 2 | 0 | 0 | 0 | 0 |
| Diethylene triamine pentamethylene phosphonic acid | 0 | 1.5 | 0 | 0 | 0 |
| $H_2O$ and miscellaneous | ← | | Balance | | → |

EXAMPLE IX

| | 1 | 2 | 3 | 4 |
|---|---|---|---|---|
| Zeolite of Example I | 20 | → | → | → |
| $Na_2CO_3$ | 10 | → | → | → |
| $Na_3$ nitrilotriacetate | 15 | 15 | 0 | 0 |
| Sodium tripolyphosphate | 0 | 0 | 25 | 25 |
| Sodium $C_{12}$ alkyl benzene sulfonate | 4 | 0 | 6 | 0 |
| Sodium $C_{14-15}$ alkyl polyethoxylate (2.25) sulfate | 6 | 10 | 6 | 10 |
| Sodium tallow alkyl sulfate | 6 | 0 | 6 | 0 |
| Sodium linoleate | 0 | 15 | 0 | 15 |
| Sodium silicate (2.0r) | 4 | → | → | → |
| Sodium sulfate | ← | | Balance | → |

-continued

| | 1 | 2 | 3 | 4 |
|---|---|---|---|---|
| ΔHWU | Control (8 gpg) | 20 (8 gpg) | Control (10 gpg) | 10 (10 gpg) |
| ΔPSU (at 8 gpg) | Control | 1.3 | Control | −0.6 |

The addition of the unsaturated soap, even with a reduction in synthetic surfactant and in the presence of an effective water soluble detergency builder, provides improved performance at higher hardness levels without the formation of undesirable soap scum.

EXAMPLE X

| | % by weight |
|---|---|
| Na zeolite X, ~2μ. particle diameter | 15 |
| K linoleate | 10 |
| Coconut alkyl dimethyl amine oxide | 5 |
| $C_{14-15}$ alkyl polyethoxylate (7) | 4 |
| $K_2CO_3$ | 7 |
| Ethyl alcohol | 3.5 |
| Sodium citrate | 10 |
| $H_2O$ and miscellaneous | ← Balance → |

What is claimed is:

1. A detergent composition consisting essentially of:
(a) from about 1% to about 20% of synthetic detergent surfactant which is an efficient soap curd dispersant, said surfactant being selected from the group consisting of:
(1) water-soluble nonionic detergent surfactants;
(2) water-soluble synthetic anionic detergent surfactants;
(3) water-soluble zwitterionic detergent surfactants;
(4) water-soluble amphoteric detergent surfactants;
(5) water-soluble semi-polar nonionic detergent surfactants; and
(6) mixtures thereof;
(b) from about 5% to about 60% of water-soluble soap of unsaturated fatty acids containing from about 16 to about 22 carbon atoms; and
(c) from about 5% to about 50% of a water-insoluble inorganic detergency builder selected from the group consisting of:
(1) zeolite A;
(2) zeolite X;
(3) zeolite P;
(4) amorphous hydrated aluminosilicate material of the empirical formula $M_z(zAlO_2.ySiO_2)$ wherein M is sodium, potassium or ammonium; z is from about 0.5 to about 2; and y is 1, said zeolites A, X and P having a particle size diameter of from about 0.01 microns to about 25 microns and containing at least 10% water of hydration and said amorphous material having a particle size diameter of less than about 25 microns, and magnesium ion exchange capacity of at least about 50 milligram equivalents of calcium carbonate hardness per gram of anhydrous aluminosilicate, and a magnesium ion exchange rate of at least about 1 grain/gallon/minute/gram/gallon; and
(5) mixtures thereof; and
(d) the balance being selected from the group consisting of water, sodium sulfate, $C_{1-4}$ alcohols, sodium silicates, sodium carbonate, and mixtures thereof, and the level of any saturated soap present being limited so that it does not exceed the level of said unsaturated soap.

2. The composition of claim 1 wherein the water-insoluble inorganic detergency builder is selected from the group consisting of zeolite A, zeolite X, and mixtures thereof containing at least about 10% water of hydration and having a particle size of from about 0.1 micron to about 10 microns in an amount from about 15% to about 40% by weight of the composition.

3. The detergent composition of claim 2 wherein the water-insoluble inorganic detergency builder contains at least about 18% water of hydration and has a crystal size from about 0.1 to about 1.5 microns.

4. The detergent composition of claim 2 wherein the water-insoluble inorganic detergency builder is zeolite A.

5. The detergent composition of claim 4 wherein the water-insoluble inorganic detergency builder contains at least about 18% water of hydration and has a crystal size from about 0.1 to about 1.5 microns.

6. The detergent composition of claim 2 wherein the synthetic detergent surfactant is selected from the group consisting of:
(a) nonionic surfactants having the formula:

$$R(Z)(C_2H_4)_xO—R^1$$

wherein R is an alkyl, hydroxy alkyl, alkylene, hydroxy alkylene, acyl, or hydroxy acyl group containing from about 8 to about 22 carbon atoms or an alkylbenzene group wherein the alkyl group contains from about 6 to about 15 carbon atoms and mixtures thereof; Z is selected from the group consisting of $$—O—,\ —N=,\ —N\begin{matrix}\diagup R' \\ \diagdown \ \end{matrix},$$

and mixtures thereof; X is a number from 0 to about 30; and R′ is selected from the group consisting of H, alkyl groups containing from 1 to about 4 carbon atoms, acyl groups containing from 2 to about 4 carbon atoms and mixtures thereof;
(b) anionic surfactants having the formula:

$$R(O)_y(R^2O)_xSO_3M$$

wherein R has the meaning given hereinbefore; Y is 0 or one, but is always one when x is more than 0; $R^2$ is selected from the group consisting of $—C_2H_4—$, $—CH_2CHOH—CH_2—$, $—CH_2CH(CH_3)—$, and mixtures thereof; x can vary from 0 to about 30; and M is selected from the group consisting of Na, K, $—N(C_2H_4OH)_{0-3}(H)_{1-4}$, Ca, Mg, and mixtures thereof;
(c) zwitterionic detergent surfactants having the formula $RL^{\oplus}R^3_{2-3}$ wherein R has the meaning given hereinbefore; $R^3$ is an alkyl group containing from 1 to about 22 carbon atoms; R or one of the $R^3$ groups is substituted with T; the portion of R or $R^3$ between L and T is interrupted by one to about ten groups selected from the group consisting of ether, ester, and amide groups and mixtures thereof; L is N, P or S; and T is $—SO_4^{\ominus}$, $—COO^{\ominus}$, or $—SO_3^{\ominus}$, there being no more than one hydrophobic group;
(d) amphoteric detergent surfactants having the formula:

$RLR^3_{1-2}$ wherein R, L and $R^3$ have the meanings given hereinbefore;

(e) semi-polar nonionic detergent surfactants having the formula:

$$RO_{0-1}(C_2H_4O)_xL(\overset{\overset{\displaystyle O}{\uparrow}}{R^4})_{1-2}$$

wherein R, L and x are as stated hereinbefore and each $R^4$ is selected from the group consisting of $C_{1-4}$ alkyl and hydroxy alkyl groups and polyethoxylate groups containing from 1 to about 10 ether linkages; and said $R^3$ groups can be connected through an oxygen or a nitrogen atom; and (f) mixtures thereof.

7. The composition of claim 6 wherein the synthetic detergent surfactant is a nonionic surfactant.

8. The composition of claim 6 wherein the synthetic detergent surfactant is an anionic detergent surfactant.

9. The composition of claim 8 wherein in the synthetic detergent surfactant R is an alkyl group and X is greater than 0.

10. The composition of claim 6 wherein the synthetic detergent surfactant is a zwitterionic detergent surfactant.

11. The detergent composition of claim 6 wherein the synthetic detergent surfactant is an amphoteric detergent surfactant.

12. The detergent composition of claim 6 wherein the synthetic detergent surfactant is a semi-polar nonionic detergent surfactant.

13. The detergent composition of claim 6 wherein the synthetic detergent is from about 2% to about 20% of the composition.

14. A detergent composition according to claim 2, claim 4 or claim 6, wherein the fatty acid of the soap contains from about 16 to about 18 carbon atoms, and the cation of the soap is selected from the group consisting of sodium, potassium, ammonium, monoethanolammonium, diethanolammonium, triethanolammonium, tetramethylammonium, and mixtures thereof.

15. A detergent composition according to claim 2, claim 4, or claim 6, wherein the unsaturated fatty acid soap is from about 10% to about 40% by weight of the composition.

* * * * *